US005931092A

United States Patent [19]

Werner et al.

[11] Patent Number: 5,931,092

[45] Date of Patent: Aug. 3, 1999

[54] DEVICE FOR CATCHING A TORN WEB OF PRINTED MATERIAL

[75] Inventors: Kettl Werner, Neusäss; Birkenfeld Andreas, Dinkelscherben, both of Germany

[73] Assignee: Grafotec GmbH, Diedorf, Germany

[21] Appl. No.: 08/876,020

[22] Filed: Jun. 13, 1997

[30] Foreign Application Priority Data

Jul. 18, 1996 [DE] Germany ..... 196 29 071

[51] Int. Cl.[6] ..... B41F 13/54

[52] U.S. Cl. ..... 101/219; 226/11

[58] Field of Search ..... 226/11; 101/219

[56] References Cited

U.S. PATENT DOCUMENTS

| | | | |
|---|---|---|---|
| 4,846,060 | 7/1989 | Proctor | 101/228 |
| 5,443,008 | 8/1995 | Pavliny et al. | 101/228 |
| 5,701,618 | 12/1997 | Brugger | 5/611 |

FOREIGN PATENT DOCUMENTS 3822496 1/1990 Germany .

*Primary Examiner*—Edgar Burr
*Assistant Examiner*—Daniel J. Colilla
*Attorney, Agent, or Firm*—Jones, Tullar & Cooper, P.C.

[57] ABSTRACT

In connection with a device for catching a torn web of printed material with a roller actuated by a drive-mechanism, the roller is arranged within an area where the tearing of webs is likely to happen, preferably behind the last roller unit of a rotational roller printing machine, and with a free turnable rotor arrangement which is pressed against the roller and is arranged on a movable carrier in the machine trestle. The carrier can be actuated by an actuating device if the web tears. A simple and robust construction a well as economical operation can be assured in that the actuating device contains at least one pneumatic cylinder which is highly pressurized to move the rotor arrangement towards the roller and which presses the rotor arrangement against the roller at reduced pressure.

13 Claims, 1 Drawing Sheet

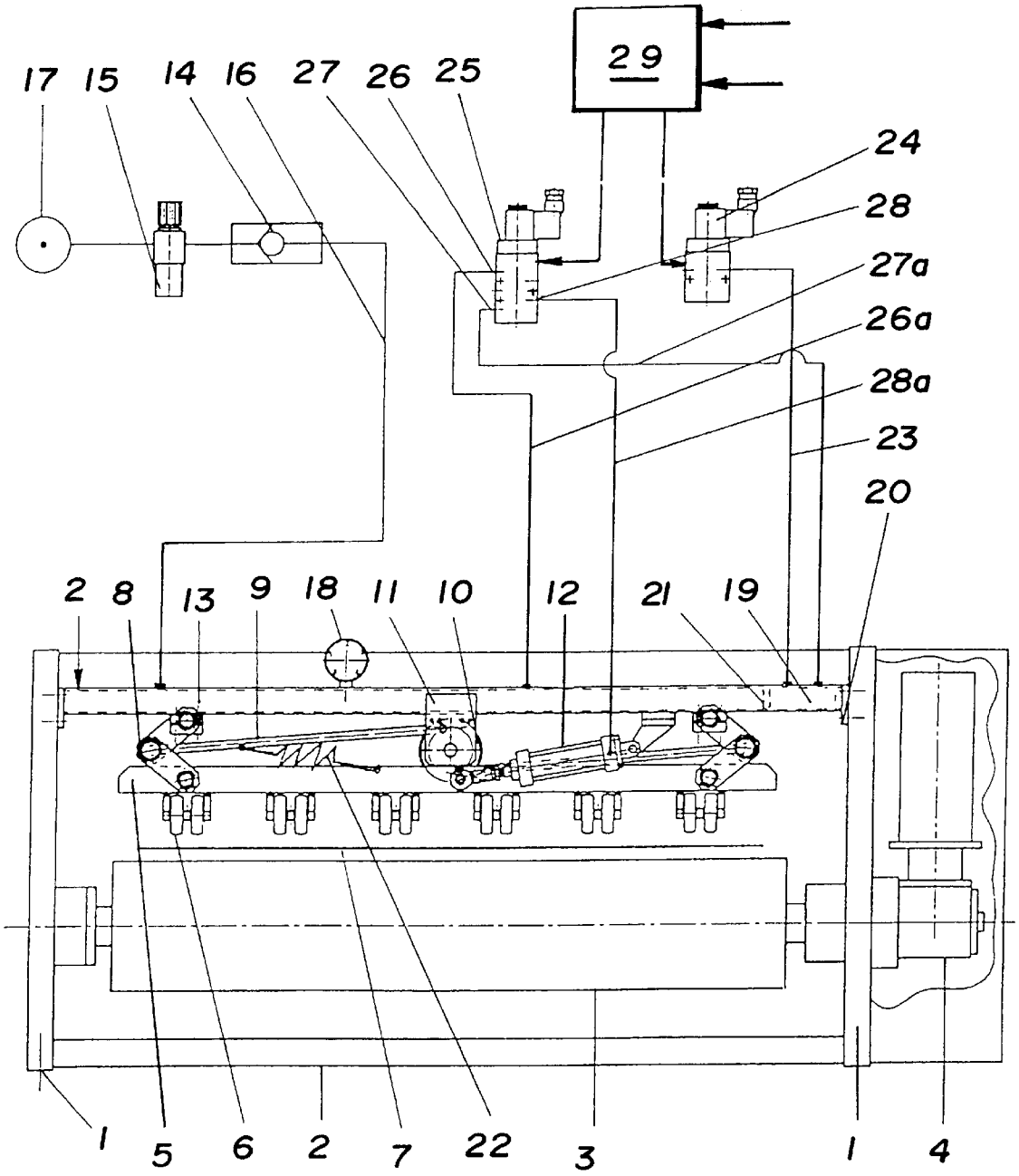
29
17
15
14
16
27
26
25
24
28
27a
26a
28a
23
20
2
8
13
9
18
11
10
12
21
19
1
5
6
2
7
22
3
1
4

DEVICE FOR CATCHING A TORN WEB OF PRINTED MATERIAL

BACKGROUND OF THE INVENTION

1. Field of the Invention

The present invention relates to a device for catching a torn web of printed material with a roller actuated by a drive-mechanism. This roller is arranged within an area where the tearing of webs is likely to happen, preferably behind the last roller unit of a rotational roller printing machine; a free turnable rotor arrangement which is pressed against the roller is arranged on a movable carrier in the machine trestle, which carrier can be actuated by an actuating device if the web tears.

2. Prior Art

A device of this kind is known from German patent publication 38 22 496, for example. In this known approach a spring unit grips the carrier containing the rotor. This spring-unit is under tension while in a standby position and secured by a locking bar which is released if the web tears. The spring-unit is relatively long, resulting in a high construction level and thus in a bulky construction. The known approach further requires a great number of parts that may cause a lot of trouble. Another main disadvantage of the known approach is that during the entire catching process the rotor arrangement is pressed against the roller by the power exerted by the spring-unit which has to be relatively strong to generate a fast acceleration following release.

This leads to high wear and tear of the rotor elements and to milling at the same time, within the area of the rubber coated roller forming the rotor arrangement, resulting in high energy requirements of the drive-mechanism driving the roller.

SUMMARY OF THE INVENTION

It is, therefore, an object of the present invention to provide an improved device as described above by avoiding the disadvantages of the known approach in a simple and cost-saving way, such that a simple and robust construction as well as economical operation are assured.

According to the present invention, the device as described above contains at least one pneumatic cylinder which is highly pressurized to move the rotor arrangement towards the roller. The cyclinder presses the rotor arrangement against the roller at reduced pressure.

These measures fully avoid the disadvantages of the known approach as described above. On the one hand, a powerful force is made available for accelerating the carrier if the web tears so that a short response time is assured within which the rotor arrangement makes contact with the roller. On the other hand, the rotor arrangement is pressed with a relatively small pressure against the roller, thus reducing wear and tear as well as the driving force.

The pneumatic cylinder which is pressurized with compressed air can be locked in an advantageous way after carrying out an actuating stroke and be connected with an expansion tank. By connecting the compressed air cylinder with the expansion tank the volume is enlarged and the pressure thus reduced. At the same time a simple and compact construction is assured.

Another advantageous approach is to provide the expansion tank with a venting duct which is controlled by a valve which opens the expansion tank after the catching process following a predetermined time delay once the printing machine has come to a standstill . This leads to a venting of the expansion tank and of the cylinder. The venting facilitates the resetting of the carrier into the standby position. In a useful approach an arrangement of readjusting springs is supplied which automatically brings about resetting after venting.

In another advantageous approach a compressed air storage unit is provided before the pneumatic cylinder which is connected to a compressed air source via a supply line provided with a check valve and a pressure control. A compressed air assembly which is usually available can be tapped and be used in an advantageous way as a compressed air source. By the measures as described above, pressure fluctuations in the compressed air assembly are avoided in the compressed air storage unit. The compressed air storage unit provided before the pneumatic cylinder assures that there is always sufficient energy for the safe operation of the pneumatic cylinder. The measures as described above thus guarantee a high degree of security.

In another development of the above-mentioned measures the carrier may be suspended via a toggle lever arrangement on a cross-piece supporting the pneumatic cylinder. This cross-piece is attached to lateral walls of the trestle and spans the roller. This approach enables easy assembly. The cross-piece is usually formed as a hollow section. This offers the advantageous possibility of integrating the compressed air storage unit and the expansion tank into the cross-piece, thus leading to a specifically simple and compact construction.

BRIEF DESCRIPTION OF THE DRAWINGS

Other features and advantages of the present invention will be apparent from the claims, and the description of the preferred embodiment taken in conjunction with the accompanying drawing, which illustrates, by way of example, the principles of the invention.

The drawing shows a device according to the present invention with schematically illustrated compressed air ducts.

DESCRIPTION OF THE PREFERRED EMBODIMENT

The device for catching a torn printed web as shown in the drawing includes a machine upright consisting of two side walls 1 and cross-pieces 2 connecting them. The machine upright further includes a roller 3 mounted in rotating position which is permanently actuated by a drive-mechanism 4. Above the roller 3 a carrier 5 is provided carrying a rotor arrangement which can be moved towards the roller 3. The carrier is formed as a continuous cross-piece spanning the length of the roller 3. This carrier 5 or cross-piece carries pairs of rollers 6 forming a rotor arrangement. These rollers are arranged at regular intervals along the length of the claim 5 and are rotating freely; said rollers may be rubber coated.

Between the roller 3 and the rotor arrangement formed by the rollers 6 a printed web 7 is fed through which is—in the case of tearing—pressed against the driven roller 3 by the rollers 6 while the tension of the web is maintained. A device for catching torn webs according to the present invention is usually arranged behind the last printing unit of a rotational roller printing machine, since in this area particularly the web 7 is most likely to tear. It is also possible to provide devices for catching of torn paper webs in other areas where tearing is likely to happen, e. g. behind the other printing units. Usually the web 7 is a paper web.

The cross-piece forming the carrier 5 is suspended by two toggle lever arrangements 8 attached symmetrically to a center line on the upper cross-piece 2 of the machine upright. This cross-piece 2 spans the roller 3. The two toggle lever arrangements 8 are connected to a crank 10 each by a rod 9 moving in opposite directions. This crank 10 is mounted on a support bed 11 attached to the upper cross-piece 2 and can be actuated by means of a pneumatic cylinder 12. The pneumatic cylinder 12 actuating the crank 10 is also supported by the upper cross-piece 2.

In the standby position as depicted the rollers 6 are arranged at a distance from the roller 3. The toggle lever arrangements 8 are bent. If the paper web tears, the crank 10 is turned by the pneumatic cylinder 12 to such a degree that the toggle lever arrangements 8 are extended over the rods 9, thus moving the carrier 5 and the rollers 6 towards the roller 3. Due to the arrangement of the toggle levers 8 in symmetrical position to the center line, the lateral forces on the sides are neutralized.

The pneumatic cylinder 12 can be pressurized with compressed air. A compressed air assembly which is usually available in a printing works can be tapped and be used as a compressed air source. To assure a supply of compressed air free of fluctuations to the pneumatic cylinder 12, a compressed air storage unit 13 is arranged before the pneumatic cylinder 12. This compressed air storage unit 13 is connected to the pressure network 17 by a supply line 16 having a check valve 14 and a pressure control value 15. The compressed air storage unit 13 is integrated into the upper cross-piece 2 of the machine upright. In the illustrated example a manometer 18 is assign ed to the compressed air storage unit 13 which thus enables a visual check of the pressure.

To assure a short response time if the web tears, i. e. to move the rollers 6 towards the roller 3 with high acceleration speed, a relatively high pressure of the compressed air used is required. To obtain a relatively low pressure of the rollers 6 against the roller 3 the air pressure in the pneumatic cylinder 12 is reduced once the rollers 6 are in touch with the roller 3. To achieve this result, the pneumatic cylinder 12 is separated from the compressed air storage unit 13 and connected with air the expansion tank 19. The volume is enlarged and the pressure thus reduced. The volume of the expansion tank 19 may roughly correspond to the stroke volume of the pneumatic cylinder 12 so that the pressure can be reduced by half.

The expansion tank 19 is also integrated into the upper cross-piece 2 of the machine upright. The cross-piece 2 is usefully formed as a hollow section. It is closed at its ends by flanges 20 by which the cross-piece 2 is attached to the side walls 1. A wall 21 divides the interior of said cross-piece 2 into the compressed air storage unit 13 and the expansion tank 19. This wall is positioned such that the volume of the expansion tank 19 roughly corresponds to the stroke volume of the pneumatic cylinder 12.

In the example illustrated, the pneumatic cylinder 12 is formed as a simple acting cylinder. The resetting movement of the pneumatic cylinder 12 and the carrier 5 with the rollers 6 is achieved by an arrangement of readjusting springs 22.

For resetting, the pneumatic cylinder 12 and the expansion tank 19 connected thereto are vented. The expansion tank 19 is provided with a venting line 23 that can be controlled by an on-off-valve 24. It is controlled in such a way that it opens the venting line 23 after the catching process is finished. This happens about 15 seconds after the printing machine has been slowed down during the catching process and has come to a standstill. With the venting of the pneumatic cylinder 12 and the expansion tank 19 connected thereto the arrangement of readjusting springs 22 comes into action, lifting the carrier 5—as described above—into the illustrated standby position. After venting the connection between the pneumatic cylinder 12 and the expansion tank 19 is interrupted, thus placing the pneumatic cylinder 12 into a position ready for new action.

In order to start the pressurizing and/or the venting of the pneumatic cylinder 12 at the desired point of time a control valve 25 is provided which takes the shape of a multiple way valve. It has three connections 26, 27, 28, where the two connections 26 and 27 are alternatively connected with and/or jointly locked against connection 28. Connection 26 is joined with the compressed air storage unit 13 via a corresponding line 26*a*. Connection 27 is connected with the expansion tank 19 by means of a corresponding line 27*a*. Connection 28 is connected with the pneumatic cylinder 12 via a line 28*a*. This pneumatic cylinder 12 is a simple acting cylinder and has only one connection line. For controlling the two control valves 24 and 25, a control device 29 is provided which processes signals coming from a tear switch which is not described here and from a sensor monitoring the machine operation; indicated on the drawing by arrows.

By means of the control device 29 the control valves 24 and 25 are controlled such that all connections as shown in the standby position are closed. If the web tears, the control valve 25 is controlled such that the lines 26*a* and 28*a* are connected with each other, resulting in pressurizing of the pneumatic cylinder 12 from the compressed air storage unit 13. As soon as the rollers 6 touch the roller 3 the connection between the lines 26*a* and 28*a* is interrupted by means of the control valve 25 and connection between the lines 27*a* and 28*a* is achieved, thus connecting the pneumatic cylinder 12 with the expansion tank 19.

The time required by the device for the rollers 6 to touch the roller 3 can easily be determined by way of experiments. The switch-over process as described above for connecting the pneumatic cylinder 12 with the expansion tank 19 can be carried out with a corresponding time delay with regard to the first switch-over process for pressurizing the pneumatic cylinder 12. To this end, the control device 29 may simply be provided with an appropriate delay unit. It is also contemplated that an appropriate sensor arranged within the area of the carrier 5, etc, records when the rollers 6 touch the roller 3 and that a corresponding control signal is fed to the control device 29.

When the catching process is finished, i.e. when the printing machine has come to a standstill, the control device 29 receives a corresponding signal. The control valve 24 is controlled within a time delay of about 15 seconds once the printing machine has come to a standstill so that the venting line 23 is opened. The control valve 25 remains in the position where the connection between the pneumatic cylinder 12 and the expansion tank 19 is open and the connection between the pneumatic cylinder 12 and the compressed air storage unit 13 is closed resulting in the venting of the pneumatic cylinder 12 and the expansion, tank 19. Thus, the force exerted on the carrier 5 stops so that the arrangement of readjusting springs 22 comes into action. The control valves 24 and 25 are controlled with a suitable delay after venting, so that the venting line 23 is closed and the connection between the expansion tank 19 and the pneumatic cylinder 12 is interrupted, while the compressed air storage unit 13 remains closed. To achieve this result a delay unit also controlling all other delays may be provided within the area of the control device 29. In case of repairs etc. a venting device for venting the compressed air storage unit 13 may be provided that can be operated manually. In normal operation, the compressed air storage unit 13 is not vented.

We claim:

1. A device for catching a torn web of printed material in a rotational roller printing machine, comprising:

a roller over which the web of printed material passes;

a drive-mechanism connected to said roller for actuating the rotation of said roller;

a free turnable rotor arrangement mounted adjacent to said roller, said free turnable rotor arrangement including a movable carrier on which a plurality of rollers are mounted;

actuating means connected to said free turnable rotor arrangement for actuating said free turnable rotor arrangement to move toward and engage said roller, said actuating means including at least one pneumatic cylinder for moving said free turnable rotor arrangement and pressing said plurality of rotors against said roller at a reduced pressure; and a pair of spaced apart lateral walls and at least one cross-piece connecting said lateral walls, said lateral walls and said at least one cross-piece defining a trestle, wherein said free turnable rotor arrangement includes a toggle lever arrangement situated on said cross-piece, and wherein said at least one cross-piece spans said roller.

2. The device as defined in claim 1, further comprising:

an expansion tank connected to said pneumatic cylinder, wherein said pneumatic cylinder is pressurized with compressed air which is vented after said pneumatic cylinder carries out an actuating stroke.

3. The device as defined in claim 2, wherein the volume of said expansion tank is adapted to be substantially equal to the stroke volume of said pneumatic cylinder.

4. The device as defined in claim 2, further comprising:

a control valve, and wherein said pneumatic cylinder includes a venting duct connected with and controlled by said control valve, said venting duct being opened after one of: a torn web of printing material is caught, and a predetermined time delay, following the rotational roller printing machine reaches a standstill condition.

5. The device as defined in claim 4, wherein the connection between said pneumatic cylinder and said expansion tank is interrupted after venting by said control valve.

6. A device as defined in claim 1, further comprising:

at least one readjusting spring connected to said movable carrier, wherein said movable carrier is shifted by said pneumatic cylinder against the force of said at least one readjusting spring.

7. The device as defined in claim 1, further comprising:

a control valve, and wherein said pneumatic cylinder includes a venting duct connected with and controlled by said control valve, said venting duct being opened after one of: a torn web of printing material is caught, and a predetermined time delay following the rotational roller printing machine reaches a standstill condition; and a further control valve embodied as a multiple way valve, said further control valve being connected to said pneumatic cylinder, said compressed air storage unit and said expansion tank, and wherein said pneumatic cylinder is alternatively joined with one of: said compressed air storage unit, and said expansion tank by said control valve.

8. The device as defined in claim 1, further comprising:

a compressed air storage unit, a compressed air source and a supply line, said supply line being provided with a check valve and a pressure control and wherein said compressed air storage unit is connected to said compressed air source via said supply line.

9. The device as defined in claim 8, wherein said compressed air storage unit is installed in at least one part of said trestle.

10. The device as defined in claim 8, wherein said expansion tank is installed in at least one part of said trestle.

11. The device as defined in claim 8, wherein said compressed air storage unit and said expansion tank are installed in at least one part of said trestle.

12. The device as defined in claim 11, wherein said cross-piece includes a hollow section closed at its ends, and wherein a wall is provided which divides the interior of said cross-piece into said compressed air storage unit and said expansion tank.

13. A device for catching a torn web of printed material in a rotational roller printing machine, comprising:

a roller over which the web of printed material passes;

a drive-mechanism connected to said roller for actuating the rotation of said roller;

a free turnable rotor arrangement mounted adjacent to said roller, said free turnable rotor arrangement including a movable carrier on which a plurality of rollers are mounted;

actuating means connected to said free turnable rotor arrangement for actuating said free turnable rotor arrangement to move toward and engage said roller, said actuating means including at least one pneumatic cylinder for moving said free turnable rotor arrangement and pressing said plurality of rotors against said roller at a reduced pressure;

a cross-piece to which said at least one pneumatic cylinder is mounted; and a compressed air storage unit, a compressed air source and a supply line, said supply line being provided with a check valve and a pressure control, wherein:

said compressed air storage unit is connected to said compressed air source via said supply line, said compressed air storage unit and said expansion tank are installed in at least one part of said cross-piece, said cross-piece includes a hollow section closed at its ends, and a wall is provided which divides the interior of said cross-piece into said compressed air storage unit and said expansion tank.

* * * * *